US008248198B2

(12) United States Patent
Imbimbo et al.

(10) Patent No.: US 8,248,198 B2
(45) Date of Patent: Aug. 21, 2012

(54) VARIABLE INDUCTOR WITH NON-MAGNETIC CORE AND METHOD OF MANUFACTURE THEREFOR

(75) Inventors: Mark Alan Imbimbo, Butler, NJ (US); Ronald Joseph Vecchio, Morris Plains, NJ (US)

(73) Assignee: Johanson Manufacturing Corporation, Boonton, NJ (US)

( * ) Notice: Subject to any disclaimer, the term of this patent is extended or adjusted under 35 U.S.C. 154(b) by 0 days.

(21) Appl. No.: 12/507,251

(22) Filed: Jul. 22, 2009

(65) Prior Publication Data

US 2011/0018668 A1 Jan. 27, 2011

(51) Int. Cl.

| | |
|---|---|
| ***H01F 30/14*** | (2006.01) |
| ***H01F 21/02*** | (2006.01) |
| ***H01F 21/10*** | (2006.01) |
| ***H01F 27/29*** | (2006.01) |
| ***H01F 7/06*** | (2006.01) |

(52) U.S. Cl. ..... 336/10; 336/30; 336/40; 336/87; 336/192; 29/606

(58) Field of Classification Search ..... None
See application file for complete search history.

(56) References Cited

U.S. PATENT DOCUMENTS

| | | | | |
|---|---|---|---|---|
| 2,438,359 A | | 3/1948 | Clapp | |
| 2,450,192 A | * | 9/1948 | Freeman, Jr. | 336/77 |
| 2,458,071 A | | 1/1949 | Gordon | |
| 2,462,822 A | * | 2/1949 | Wood | 336/136 |
| 2,568,310 A | | 9/1951 | Whiffen | |
| 2,588,406 A | * | 3/1952 | Munson | 336/118 |
| 2,838,738 A | * | 6/1958 | Antalek et al. | 336/136 |
| 3,014,190 A | * | 12/1961 | Sutton, Jr. | 336/92 |
| 3,239,782 A | | 3/1966 | Henke | |
| 3,495,201 A | * | 2/1970 | Marker Jr. | 336/90 |
| 3,517,363 A | | 6/1970 | Curtis, III et al. | |
| 3,648,205 A | * | 3/1972 | Bunch et al. | 336/20 |
| 3,891,918 A | | 6/1975 | Ellis | |
| 3,905,002 A | * | 9/1975 | McFarlane | 336/136 |
| 4,034,325 A | * | 7/1977 | Zarkov | 336/75 |
| 4,127,836 A | * | 11/1978 | Slenker | 336/136 |
| 4,188,603 A | | 2/1980 | Tsoutsas | |
| 4,381,678 A | * | 5/1983 | Lombard et al. | 73/728 |
| 4,938,069 A | * | 7/1990 | Shoji et al. | 73/728 |
| 5,550,523 A | | 8/1996 | Rouet et al. | |
| 6,509,821 B2 | | 1/2003 | Oldfield | |
| 6,919,788 B2 | | 7/2005 | Holdahl et al. | |
| 7,164,388 B2 | | 1/2007 | Aisenbrey | |
| 7,567,759 B2 | * | 7/2009 | Kanesaka | 398/136 |

FOREIGN PATENT DOCUMENTS

| | | | |
|---|---|---|---|
| JP | 60-144918 A | * | 7/1985 |
| JP | 01268007 A | * | 10/1989 |
| JP | 02042705 A | * | 2/1990 |

* cited by examiner

*Primary Examiner* — Mohamad Musleh
*Assistant Examiner* — Mangtin Lian
(74) *Attorney, Agent, or Firm* — McCarter & English, LLP

(57) ABSTRACT

A variable inductor is provided. The variable inductor includes a dielectric core having a helical thread on an outer surface thereof for receiving the coil, and a non-magnetic element positioned coaxially within the core. The non-magnetic element could be provided in the form of a bushing or a solid rod, and could be manufactured from any suitable, non-magnetic metal, such as copper, brass, etc.

14 Claims, 6 Drawing Sheets

VARIABLE INDUCTOR WITH NON-MAGNETIC CORE AND METHOD OF MANUFACTURE THEREFOR

BACKGROUND OF THE INVENTION

1. Field of the Invention

The present invention relates to inductors. More specifically, the present invention relates to a variable inductor having a non-magnetic core, and a method of manufacturing same.

2. Related Art

Inductance is a fundamental property of an electrical circuit or circuit element, whereby an electromotive force is induced in the circuit or element as the result of a changing magnetic flux (e.g., a change in magnetic flux due to an alternating current flowing through a coil). Often, it is desirable to change the inductance of a circuit so as to alter the resonant frequency of the circuit. For example, in radio frequency (RF) applications, it is often necessary to tune a circuit to a desired frequency in the radio spectrum. This is often accomplished by altering the inductance of the circuit, using a device known as an inductor.

Inductors can be fixed or variable. A fixed inductor is a coil of wire wrapped around a core, which can either be a dielectric (e.g., air, plastic, etc.) or a metal (e.g., soft iron, etc.). Fixed inductors provide a specific, pre-defined, non-variable level of inductance. Variable inductors, on the other hand, can provide a range of inductance levels, and can be adjusted as desired. One type of variable inductor is a coil of wire wrapped around a dielectric core, and a magnetic, metallic core positioned coaxially within the dielectric core. The position of the core can be adjusted with respect to the coil to alter the resonant frequency of the coil, by rotating the core with respect to the coil.

SUMMARY OF THE INVENTION

The present invention relates to a variable inductor having a non-magnetic core. The coil includes a dielectric core having a helical thread on an outer surface thereof for receiving the coil, and a non-magnetic element positioned coaxially within the core. The non-magnetic element could be provided in the form of a bushing or a solid rod, and could be manufactured from any suitable, non-magnetic metal, such as copper, brass, etc. The dielectric core is preferably manufactured from a dielectric material having a low coefficient of friction (e.g., polytetrafluoroethylene, sold under the trademark TEFLON), to allow for precise adjustment of the inductor.

The present invention also relates to a method for manufacturing a variable inductor. The method includes the steps of forming a dielectric core having a helical thread on an outer surface thereof and a recess coaxial with the central longitudinal axis of the dielectric core; forming a non-magnetic element; positioning the non-magnetic element within the recess of the dielectric core; and forming a coil of wire about the dielectric core.

BRIEF DESCRIPTION OF THE DRAWINGS

The foregoing features of the invention will be apparent from the following Detailed Description of the Invention, taken in connection with the accompanying drawings, in which.

DETAILED DESCRIPTION OF THE INVENTION

The present invention relates to a variable inductor, as discussed in detail below in connection with FIGS. 1-9.

Figure 1:
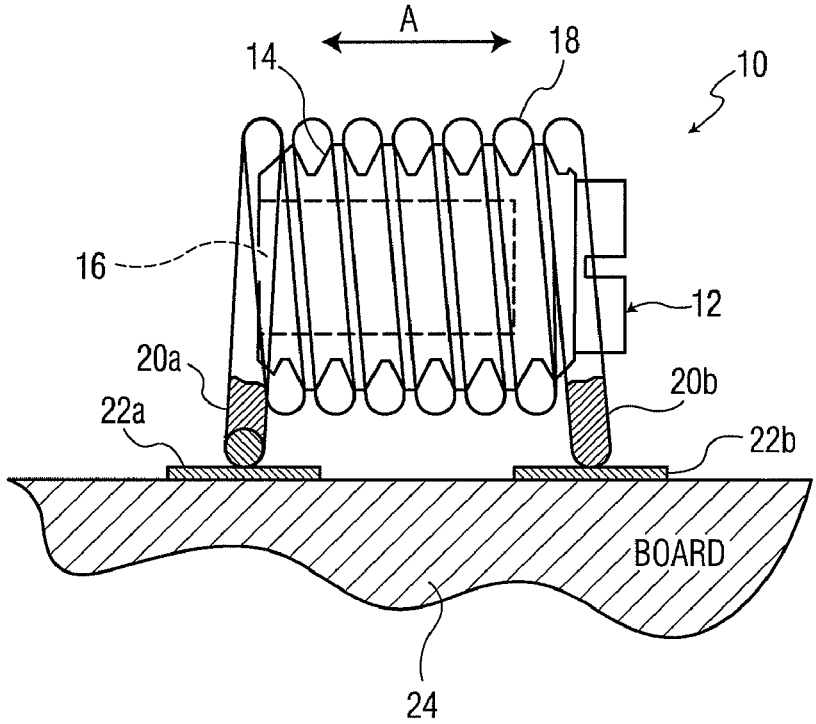
FIG. 1 is front view of the variable inductor of the present invention.
Figure 2:
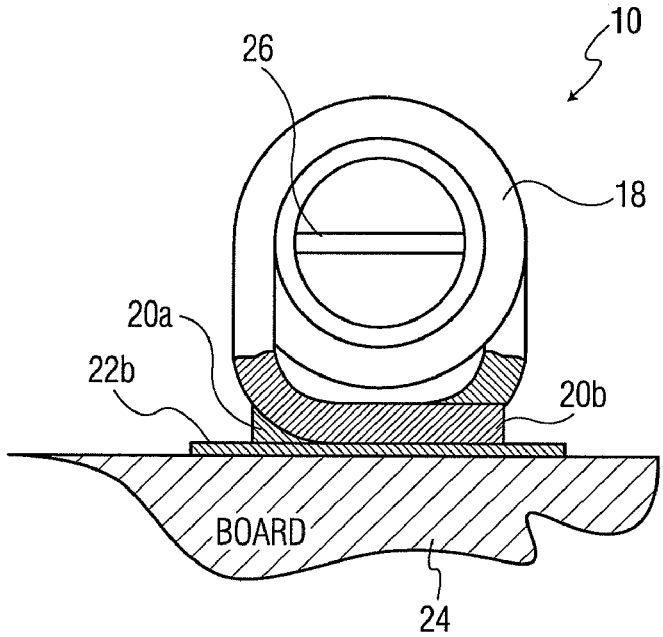
FIG. 2 is a side view of the variable inductor of FIG. 1.

FIGS. 1-2 are front and side views, respectively, of the variable inductor of the present invention, indicated generally at 10. The variable inductor 10 includes a dielectric core 12 having a helical thread 14 on an outer surface thereof, and a non-magnetic, metallic element 16 positioned coaxially within the core 12. The helical thread 14 receives a coil of wire 18, such that the core 12 can be rotated to cause the core 12 to move with respect to the coil 18, along the general direction shown by arrow A. This causes the non-magnetic element 16 to move with respect to the coil to vary the inductance of the variable inductor 10, as desired. The coil 18 includes terminal ends 20*a*, 20*b* which allow for surface mounting of the variable inductor 10 to a circuit board 24 via solder pads 22*a*, 22*b*. As shown, the terminal ends 20*a*, 20*b* are positioned transverse to the central longitudinal axis of the variable inductor 10. It is noted that the terminal ends 20*a*, 20*b* could also extend downwardly so as to allow insertion of the ends 20*a*, 20*b* into corresponding holes of the circuit board 24 and subsequent soldering (i.e., through-hole mounting of the inductor 10). Also, as discussed herein in connection with FIGS. 8-9, the terminal ends 20*a*, 20*b* could extend parallel to the central longitudinal axis of the variable inductor 10.

It is noted that any desired number of turns of wire could be provided in the coil 18 (and, the thread 14 of the dielectric core 12 could be lengthened or shortened to accommodate such number of turns), to provide a device having a inductance range. Table 1, below, provides a list of sample operating characteristics of the variable inductor 10 of the present invention, corresponding to various turns of wire in the coil 18:

TABLE 1

| Number of Turns | Self-Resonant Frequency (GHz) | Q Value (at 100 MHz) | Inductance Range (L (nHy), +/−5%) |
|---|---|---|---|
| 2 | 1.2 | 90 | 33 |
| 3 | 1.0 | 95 | 49 |
| 4 | 0.9 | 101 | 64 |
| 5 | 0.9 | 114 | 81 |
| 6 | 0.6 | 102 | 99 |
| 7 | 0.7 | 121 | 118 |
| 9 | 0.7 | 150 | 150 |

The core 12 is preferably made from polytetrafluoroethylene material (sold under the trademark TEFLON) conforming to American Society for Testing and Materials (ASTM)

Standard D 1710 or equivalent. Such material is a lightweight, dielectric material having a low coefficient of friction, which facilitates easy operation of the inductor 10, i.e., reduced friction when the core 12 is rotated within the coil 18. Of course, other dielectric materials could be used, such as plastic, ceramic, etc., without departing from the spirit or scope of the present invention. A slot 26 could be provided on one end of the core 12 for receiving a tool (e.g., a flat-blade screwdriver) for rotating the core 12.

Figure 3:
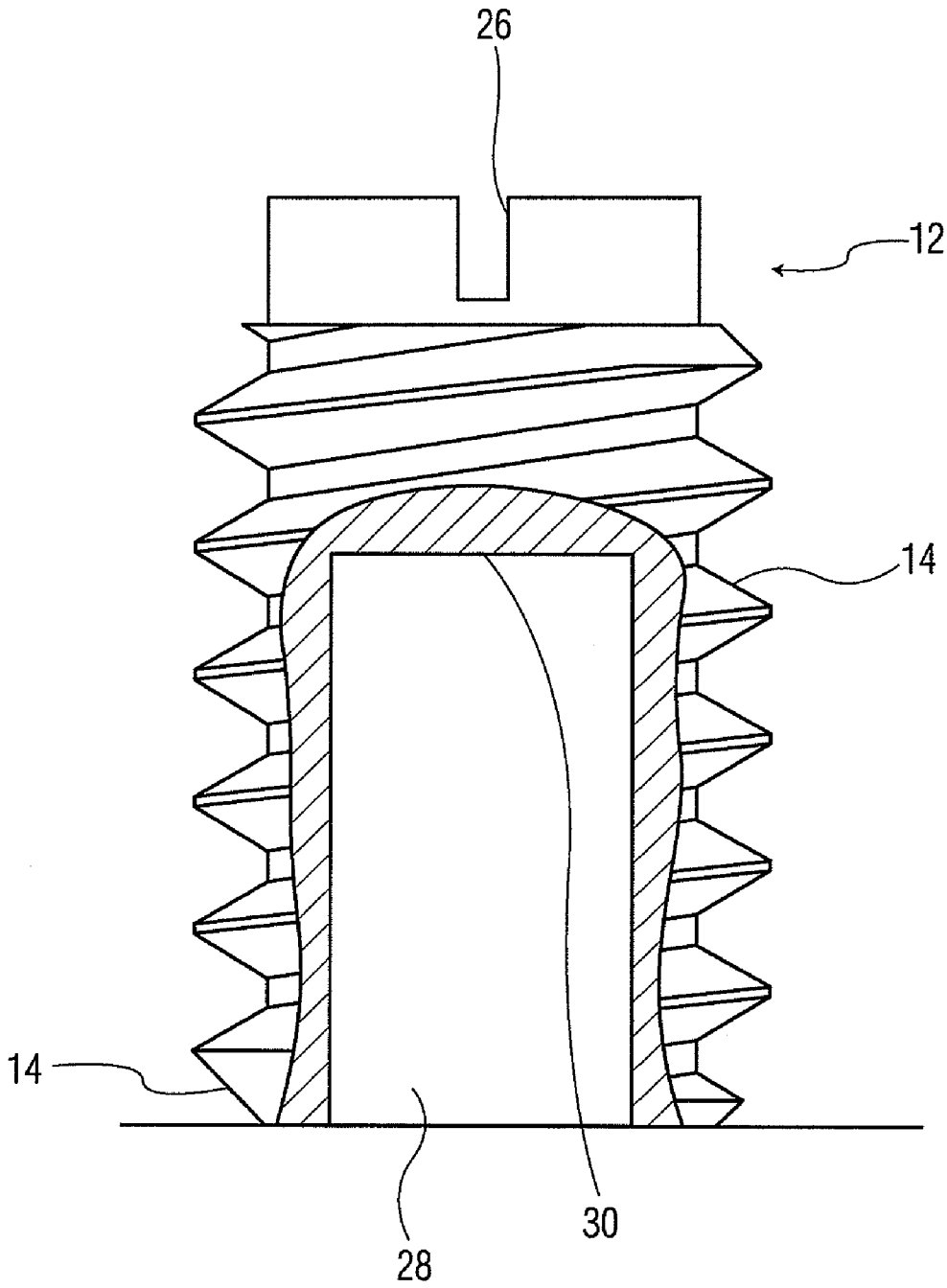
FIG. 3 is a partial cross-sectional view of the core of the variable inductor of the present invention.

FIG. 3 is a partial cross-sectional view of the core 12 of FIG. 1. The core 12 includes a recess 28 for receiving the non-magnetic, metallic element 16, and an end wall 30 within the recess 28. The recess 28 is coaxial with the central longitudinal axis of the core 12. One end of the element 16 abuts the end wall 30 when the element 16 is positioned within the recess 28, and the opposite end of the element 16 is exposed and flush with the end of the core 12. The element 16 could be held in place within the recess 28 by means of a friction fit, or by gluing/epoxying. Also, as noted above, the length of the helical thread 14 is dependent upon the number of turns of wire provided in the coil 18. While the precise dimensions of the core 12 could be varied as desired, it has been found that a major thread diameter of 0.225 inches, a minor thread diameter of 0.167 inches, a thread density of 20 threads per inch, and an inner diameter in the range of 0.118-0.121 inches are preferable.

Figure 4A:
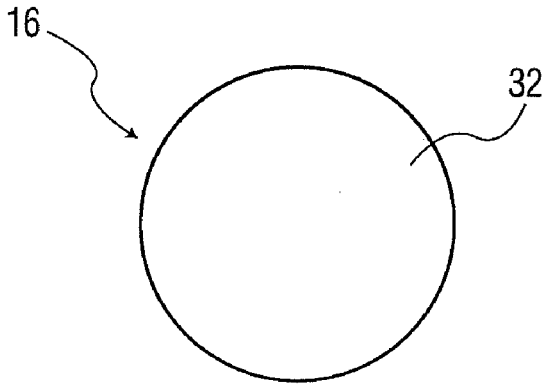
FIGS. 4A-4B are top and front views, respectively, of a solid rod version of the non-magnetic element of the variable inductor of the present invention.
Figure 4B:
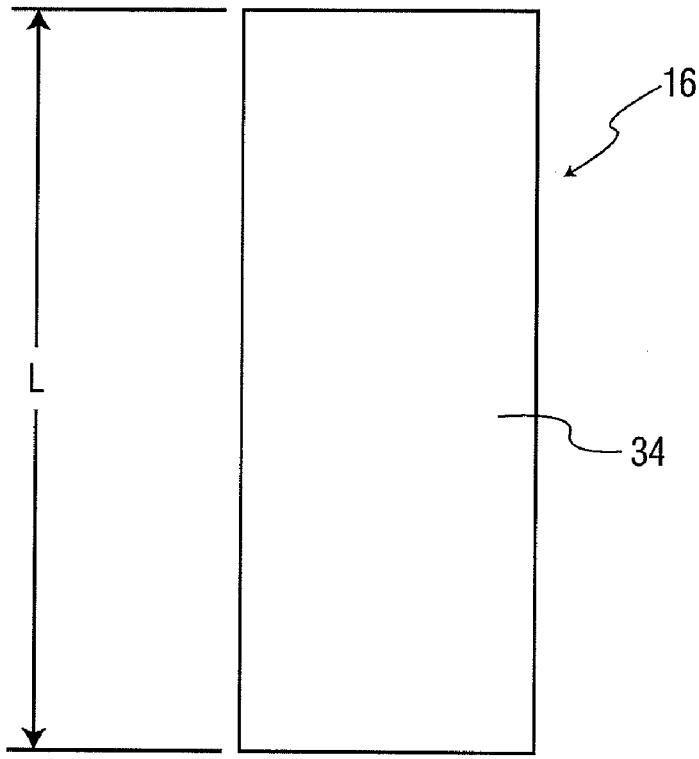

FIGS. 4A-4B are top and front views, respectively, of the non-magnetic, metallic element 16. The element 16 is a solid, cylindrical bar of non-magnetic metal, such as copper, and includes end surfaces 32 and a cylindrical surface 34. One of the end surfaces 32 abuts the end wall 30 when the element 16 is positioned within the recess 28 of the core 12. The opposite end surface 32 is exposed when the element 16 is positioned within the recess 28, and is flush with the end of the core 12. The element 16 has a length L which can vary depending upon the number of turns provided in the coil 18. Examples of the length L include, but are not limited to, 0.160-0.295 inches. Also, the element 16 could have a diameter of 0.125 inches, but other dimensions are acceptable.

Figure 5:
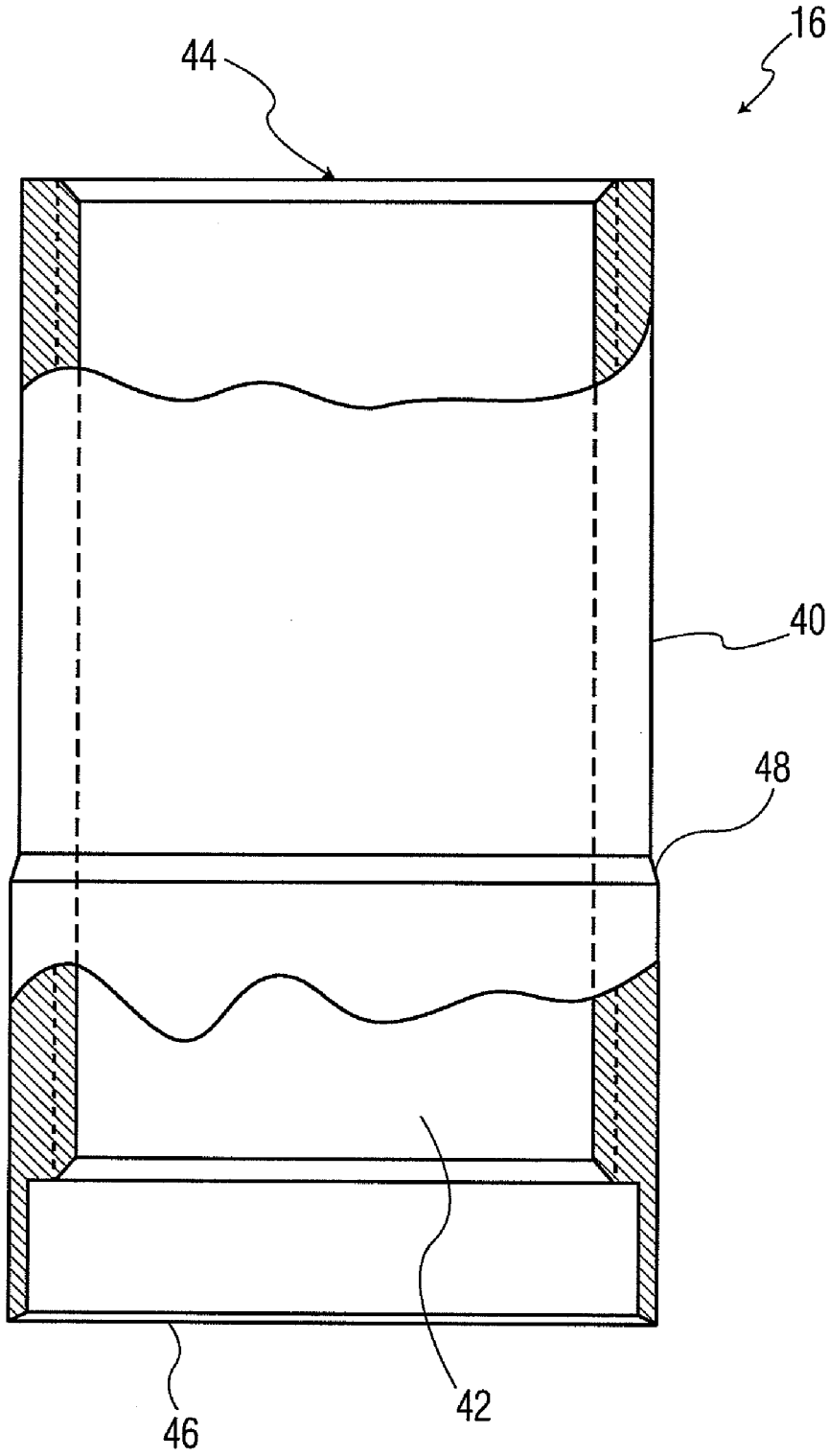
FIG. 5 is a partial cross-sectional view of a hollow bushing version of the non-magnetic element of the variable inductor of the present invention.

FIG. 5 is a side view of a hollow version of the non-magnetic, metallic element 16. In this version, the element 16 is in the form of a bushing having a cylindrical outer surface 40, a bore 42, and ends 44, 46. Optionally, a step 48 could be provided on the outer surface 40. The element 16 could be formed from a suitable, non-magnetic metal such as brass. While the precise dimensions of the element 16 could be varied as desired, staggered outer diameters of 0.116 and 0.118 inches and staggered inner diameters of 0.0920 and 0.1115 inches are preferable. As with the solid version, the length of the hollow bushing version of the element 16 can vary depending upon the number of turns provided in the coil 18.

Figure 6:
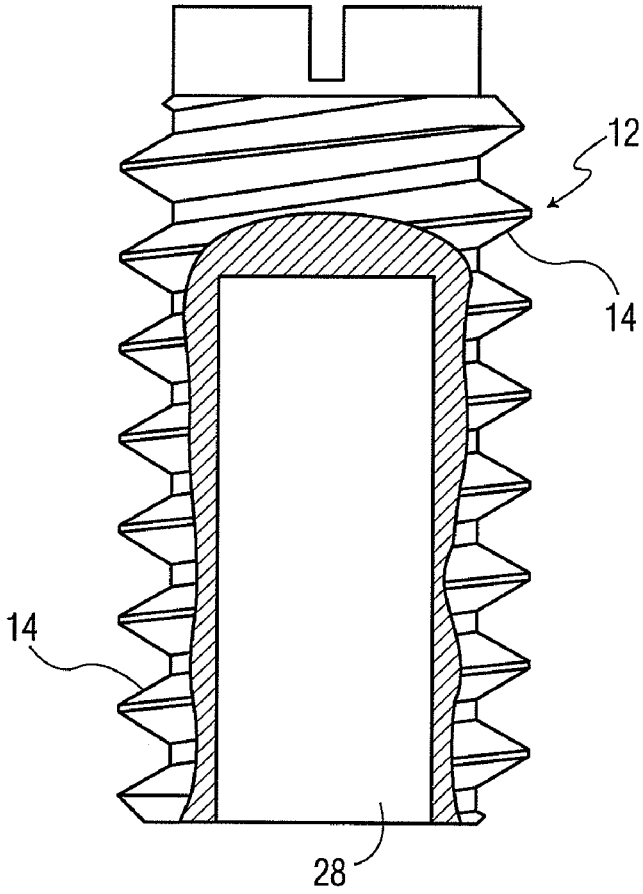
FIGS. 6-7 are partial cross-sectional views showing cores of the variable inductor of the present invention having different lengths.
Figure 7:
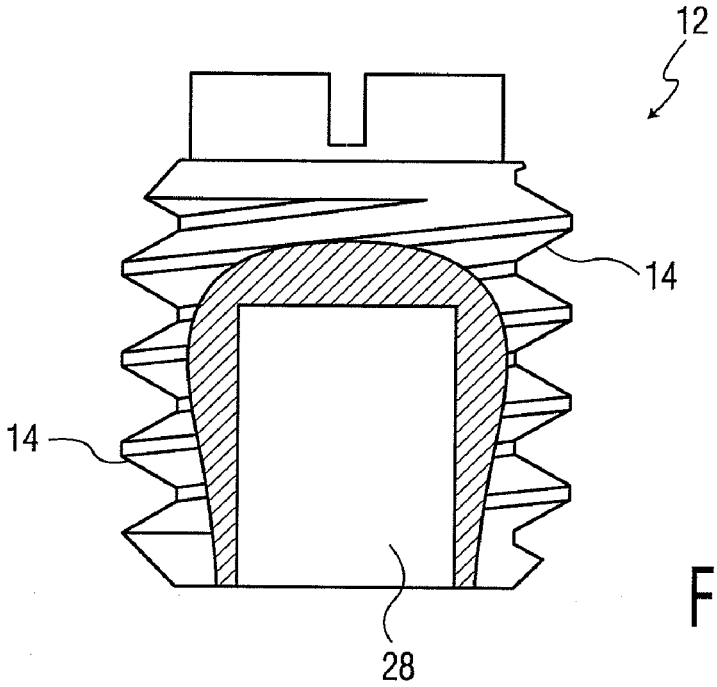

As mentioned above, the core 12 of the present invention could be provided in various lengths to accommodate a desired number of turns of the coil 18, so as to provide a variable inductor having desired operating characteristics. For example, as shown in FIG. 6, a longer core 12 having a length of 0.450 inches could be provided, which accommodates a coil having 8 turns. Also, as shown in FIG. 7, a shorter core 12 having a length of 0.236 inches could be provided, which accommodates a coil having 4 turns.

Figure 8:
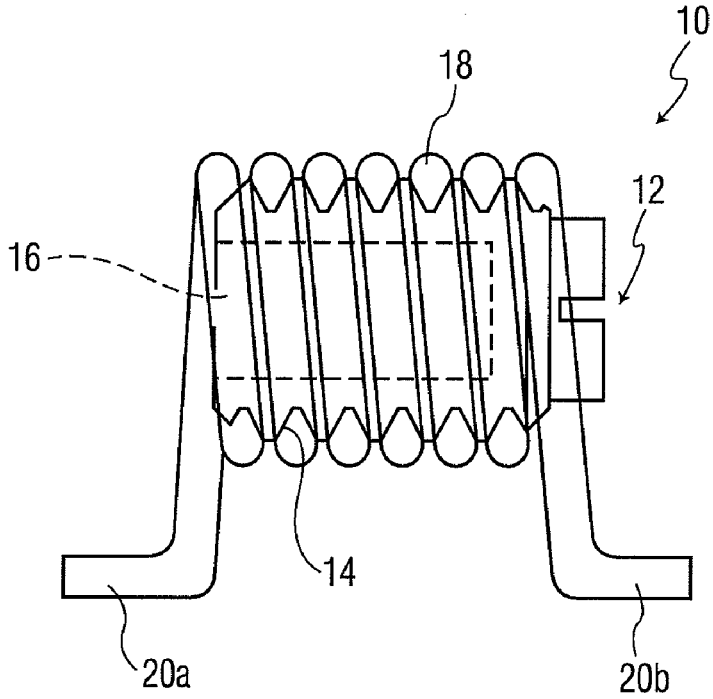
FIGS. 8-9 are front and side views, respectively, of the variable inductor of the present invention, wherein the terminal ends of the coil are positioned parallel to the central longitudinal axis of the variable inductor.
Figure 9:
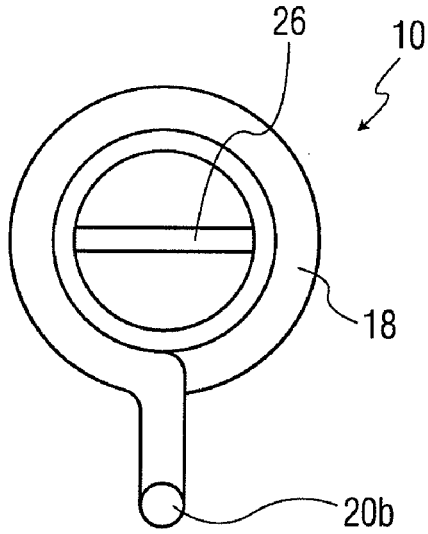

FIGS. 8-9 are front and side views, respectively, of the variable inductor 10 of the present invention, wherein the terminal ends 20*a*-20*b* of the coil 18 are positioned parallel to the central longitudinal axis of the variable inductor. This configuration permits surface mounting of the inductor 10 (as with the transverse configuration shown in FIGS. 1-2). As mentioned above, the terminal ends 20*a*-20*b* could also be transverse to the central longitudinal axis of the variable inductor, or they could extend downwardly so as to facilitate through-hole mounting of the inductor to a circuit board.

It is expressly noted that the dimensions set forth herein are illustrative in nature, and are not intended to limit the scope of the present invention.

The present invention could be manufactured using the following process. First, the dielectric core 12 is fabricated from a length of PTFE stock, such that the helical thread 14 is formed on an outer surface thereof by machining or milling. Then, the recess 28 is formed coaxial with the central longitudinal axis of the core 12 by drilling to a depth sufficient to accommodate the non-magnetic element 16. The non-magnetic element 16 is then formed from copper or brass, using conventional milling or machining techniques and, optionally, conventional drilling techniques (in the case of the hollow bushing version of the element). Once formed, the non-magnetic element 16 is inserted into the recess 28. Optionally, an adhesive could be applied to the inner surfaces of the recess 28 prior to insertion of the non-magnetic element 16. Finally, the coil 18 is formed around the core 12 from a length of wire, and ends of the wire are bent at desired angles to form the terminal ends 20*a*, 20*b*. A protective coating could be provided on the coil 18, and it is noted that the terminal ends 20*a*, 20*b* could also be pre-tinned, such that a thin coating of solder is applied to the ends 20*a*, 20*b* after the protective coating on the coil 18 is abraded off the terminal ends 20*a*, 20*b* in order to facilitate soldering of the present invention to a circuit board.

Having thus described the invention in detail, it is to be understood that the foregoing description is not intended to limit the spirit or scope thereof. What is desired to be protected is set forth in the following claims.

What is claimed is:

1. A variable inductor, comprising:

a dielectric core having a threaded portion on an outer surface thereof and a recess coaxial with the central longitudinal axis of the dielectric core;

a solid, non-magnetic rod positioned within the coaxial recess, the rod extending beyond half the length of the dielectric core; and a coil received by the threaded portion of the dielectric core, wherein the dielectric core can be rotated to move the rod and the threaded portion of the dielectric core with respect to the coil from a first position where the entire length of the rod and the threaded portion of the dielectric core are surrounded by the coil to a second position where a portion of the rod extends beyond the coil, to vary the inductance of the variable inductor.

2. The variable inductor of claim 1, wherein the dielectric core comprises a polytetrafluoroethylene dielectric material.

3. The variable inductor of claim 2, wherein the rod comprises a solid copper rod.

4. The variable inductor of claim 1, wherein the coil comprises terminal ends for mounting the variable inductor to a surface.

5. A variable inductor, comprising:

a polytetrafluoroethylene dielectric core having a threaded portion on an outer surface thereof and a recess coaxial with the central longitudinal axis of the dielectric core;

a metallic, non-magnetic element positioned within the coaxial recess, the non-magnetic element extending beyond half the length of the dielectric core; and a coil received by the threaded portion of the dielectric core, wherein the dielectric core can be rotated to move the non-magnetic element and the threaded portion of the dielectric core with respect to the coil from a first position where the entire length of the rod and the threaded portion of the dielectric core are surrounded by the coil to a second position where a portion of the rod extends beyond the coil, to vary the inductance of the inductor.

6. The variable inductor of claim 5, wherein the non-magnetic element comprises a solid rod.

7. The variable inductor of claim 5, wherein the non-magnetic element comprises a bushing.

8. The variable inductor of claim 5, wherein the coil comprises terminal ends for mounting the variable inductor to a surface.

9. A method for manufacturing a variable inductor, comprising the steps of:

forming a dielectric core having a helical threaded portion on an outer surface thereof and a recess coaxial with the central longitudinal axis of the dielectric core;

forming a non-magnetic element;

positioning the non-magnetic element within the recess of the dielectric core, the non-magnetic element extending beyond half the length of the dielectric core; and forming a coil of wire about the dielectric core so that the dielectric core can be rotated to move the non-magnetic element and the threaded portion of the dielectric core from a first position where the entire length of the non-magnetic element and the threaded portion of the dielectric core are surrounded by the coil to a second position where a portion of the rod extends beyond the coil.

10. The method of claim 9, wherein the step of forming the dielectric core comprises drilling the dielectric core to form the recess.

11. The method of claim 9, wherein the step of forming the non-magnetic element comprises forming a solid rod of non-magnetic material.

12. The method of claim 9, wherein the step of forming the non-magnetic element comprises forming a bushing of non-magnetic material.

13. The method of claim 9, further comprising the step of providing an adhesive within the recess prior to positioning the non-magnetic element within the recess.

14. The method of claim 9, further comprising pre-tinning terminal ends of the coil.

* * * * *